US009200217B2

(12) United States Patent
Sagawa et al.

(10) Patent No.: US 9,200,217 B2
(45) Date of Patent: Dec. 1, 2015

(54) GAS OIL COMPOSITION AND METHOD FOR PRODUCING SAME

(75) Inventors: Shunta Sagawa, Tokyo (JP); Yasuyuki Iwasa, Tokyo (JP); Shinichiro Yanagawa, Tokyo (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 198 days.

(21) Appl. No.: 14/117,218

(22) PCT Filed: May 14, 2012

(86) PCT No.: PCT/JP2012/062311

§ 371 (c)(1),
(2), (4) Date: Nov. 12, 2013

(87) PCT Pub. No.: WO2012/161018

PCT Pub. Date: Nov. 29, 2012

(65) Prior Publication Data

US 2014/0319023 A1 Oct. 30, 2014

(30) Foreign Application Priority Data

May 26, 2011 (JP) ..... 2011-117600

(51) Int. Cl.

| | |
|---|---|
| ***C10L 1/08*** | (2006.01) |
| ***C10G 57/00*** | (2006.01) |
| ***C10G 11/05*** | (2006.01) |
| *C10L 1/04* | (2006.01) |

(52) U.S. Cl.

CPC ..... *C10G 57/00* (2013.01); *C10G 11/05* (2013.01); *C10L 1/08* (2013.01); *C10G 2300/1096* (2013.01); *C10G 2300/202* (2013.01); *C10G 2300/301* (2013.01); *C10G 2300/304* (2013.01); *C10G 2300/307* (2013.01); *C10G 2400/04* (2013.01); *C10L 2200/0438* (2013.01); *C10L 2290/24* (2013.01)

(58) Field of Classification Search

CPC ..... C10L 1/04; C10L 1/08; C10L 2200/04; C10L 2200/0438; C10G 2300/301; C10G 2300/304; C10G 2300/1059; C10G 2300/1062

See application file for complete search history.

(56) References Cited

U.S. PATENT DOCUMENTS

| | | | | |
|---|---|---|---|---|
| 6,210,563 | B1 | 4/2001 | Tsao et al. | |
| 2007/0144942 | A1 | 6/2007 | Tiitta et al. | |
| 2007/0227946 | A1 * | 10/2007 | Dierickx | 208/113 |
| 2008/0256846 | A1 | 10/2008 | Yoshida et al. | |

FOREIGN PATENT DOCUMENTS

| | | | |
|---|---|---|---|
| JP | 2002-530475 | A | 9/2002 |
| JP | 2003-502478 | A | 1/2003 |
| JP | 2006-137922 | A | 6/2006 |
| JP | 2007-512127 | A | 5/2007 |
| JP | 2008-144158 | A | 6/2008 |
| JP | 2008-214369 | A | 9/2008 |
| JP | 2008-248175 | A | 10/2008 |
| JP | 2009-167257 | A | 7/2009 |
| JP | 2010-070732 | A | 4/2010 |
| WO | 0029517 | A1 | 5/2000 |

OTHER PUBLICATIONS

Int'l Search Report issued Jul. 3, 2012 in Int'l Application No. PCT/JP2012/062311.

* cited by examiner

*Primary Examiner* — Brian McCaig
(74) *Attorney, Agent, or Firm* — Panitch Schwarze Belisario & Nadel LLP

(57) ABSTRACT

The present invention provides a method for producing a gas oil composition which contains a cracked base gas oil with a poor oxidation stability but is enhanced in oxidation stability resulting in less sludge or deposit formation. The method comprises blending 0.5 to 15 percent by volume of a cracked reformed base oil having a total aromatic content of 80 to 100 percent by volume, a bicyclic aromatic content of 40 to 95 percent by volume, a 10 vol. % distillation temperature of 160 to 250° C. and a 90 vol. % distillation temperature of 260 to 330° C. and 10 to 70 percent by volume of a cracked base gas oil thereby producing a gas oil composition with an induction period of 60 minutes or longer, a sulfur content of 10 ppm by mass or less and a cetane number of 45 or greater.

7 Claims, No Drawings

GAS OIL COMPOSITION AND METHOD FOR PRODUCING SAME

CROSS-REFERENCE TO RELATED APPLICATION

This application is a Section 371 of International Application No. PCT/JP2012/062311, filed May 14, 2012, which was published in the Japanese language on Nov. 29, 2012 under International Publication No. WO 2012/161018 A1, and the disclosure of which is incorporated herein by reference.

TECHNICAL FIELD

The present invention relates to gas oil compositions and methods for producing the same, more specifically to a gas oil composition enhanced in oxidation stability and thus forming less sludge or deposit.

BACKGROUND ART

Conventional base oils of gas oils are known to be produced by subjecting a straight-run gas oil or straight-run kerosene obtained from an atmospheric distillation unit for crude oil to a hydrorefining or hydrodesulfurization treatment. Conventional gas oil compositions are produced by blending one or more types of these base gas oils and base kerosenes. If necessary, these gas oil compositions are blended with additives such as a cetane number improver or a detergent (see, for example, Non-Patent Literature 1).

Furthermore, in recent years, due to changes in the structure of petroleum fuel demands, gas oil fractions obtained from a fluid catalytic cracker, thermal cracker or hydrocarcker, which fractions have been used mainly as base oils for heavy oil have been expected to be redundant, and it has thus been studied to hydrodesulfurize such gas oil fractions available from these units to be used effectively as base gas oils.

However, the base gas oils produced in this manner are poor in oxidation stability and as the result has been concerned for the formation of sludge or the formation of deposit during the engine combustion.

Therefore, it is necessary to produce a gas oil composition though containing such a base gas oil with a poor oxidation stability but capable of restraining the formation of sludge or deposit, reducing $CO_2$ emission, improving the fuel economy and giving good influences on parts in an engine. Furthermore, since these engine-related performances are closely related to other fuel performances, it is extremely difficult to design a high quality fuel that can simultaneously achieve these requisite performances at higher levels.

CITATION LIST

Non-Patent Literature

Non-Patent Literature 1: "Nenryo Kogaku Gairon", by Konishi Seiichi, Shokabo Publishing Co., Ltd., March, 1991, pages 136 to 144

SUMMARY OF INVENTION

Technical Problem

The present invention has an object to produce a gas oil composition which contains a cracked base gas oil with a poor oxidation stability but is enhanced in oxidation stability resulting in less sludge or deposit formation.

Solution to Problem

As the results of extensive studies by the inventors of the present invention to achieve the above object, they have focused on the use of a cracked reformed base oil as a base gas oil with a higher oxidation stability and the present invention has been accomplished on the basis of the finding a way of significantly improving the oxidation stability by mixing such a base oil with a cracked base gas oil with a poor oxidation stability.

That is, the present invention is described as follows:

[1] a method for producing a gas oil composition with an induction period of 60 minutes or longer, a sulfur content of 10 ppm by mass or less and a cetane number of 45 or greater, comprising blending 0.5 to 15 percent by volume of a cracked reformed base oil having the following properties (1) to (4) and 10 to 70 percent by volume of a cracked base gas oil:

(1) a total aromatic content of 80 to 100 percent by volume;

(2) a bicyclic aromatic content of 40 to 95 percent by volume;

(3) a 10 vol. % distillation temperature of 160 to 250° C.; and (4) a 90 vol. % distillation temperature of 260 to 330° C.

[2] the method for producing a gas oil composition according to [1] above wherein the composition has a slow-cooling cloud point of −5° C. or lower.

[3] the method for producing a gas oil composition according to [1] or [2] above wherein the cracked reformed base oil is produced by bringing a feedstock having a 10 vol. % distillation temperature of 140° C. or higher and a 90 vol. % distillation temperature of 380° C. or lower into contact with a catalyst for a cracking and reforming reaction containing a medium pore zeolite and/or a large pore zeolite to be cracked and reformed through a cracking and reforming reaction at a reaction temperature of 400 to 650° C. and a reaction pressure of 1.5 MPaG or lower for a contact time of 1 to 300 seconds.

[4] a gas oil composition produced by the method according to any one of [1] to [3] above.

Advantageous Effect of Invention

The present invention can produce a gas oil composition enhanced in oxidation stability resulting in less formation of sludge or deposit though containing a cracked base gas oil with a poor oxidation stability.

DESCRIPTION OF EMBODIMENTS

The present invention will be described in detail below.

The method for producing a gas oil composition of the present invention is characterized by blending 0.5 to 15 percent by volume of a cracked reformed base oil having a total aromatic content of 80 to 100 percent by volume, a bicyclic aromatic content of 40 to 95 percent by volume, a 10 vol. % distillation temperature of 160 to 250° C. and a 90 vol. % distillation temperature of 260 to 330° C. and 10 to 70 percent by volume of a cracked gas oil.

The cracked reformed base oil is blended in an amount of 0.5 percent by volume or more, preferably 1 percent by volume or more, more preferably 1.5 percent by volume or more on the basis of the total mass of the gas oil composition with the objective of improving the oxidation stability. The cracked reformed base oil is also blended in an amount of 15 percent by volume or less, preferably 10 percent by volume or less, more preferably 8 percent by volume or less with the objective of preventing the combustibility from deteriorating.

Necessarily, the cracked reformed base oil used in the method for producing a gas oil composition of the present invention has a total aromatic content of 80 to 100 percent by volume, a bicyclic aromatic content of 40 to 95 percent by volume, a 10 vol. % distillation temperature of 160 to 250° C. and a 90 vol. % distillation temperature of 260 to 330° C.

The cracked reformed base oil used in the method for producing a gas oil composition of the present invention has a total aromatic content of preferably 80 percent by volume or more, more preferably 85 percent by volume or more, more preferably 90 percent by volume or more with the objective of improving the rubber swellability of the gas oil composition after production thereof. The aromatic content used herein denotes the value measured in accordance with JPI-5S-49-97 "Petroleum Products-Determination of Hydrocarbon Types-High Performance Liquid Chromatography".

The cracked reformed base oil used in the method for producing a gas oil composition of the present invention has a bicyclic aromatic content of preferably 40 percent by volume or more, more preferably 45 percent by volume or more, more preferably 50 percent by volume or more with the objective of improving the oxidation stability. The cracked reformed base oil has a bicyclic aromatic content of preferably 95 percent by volume or less, more preferably 90 percent by volume or less, more preferably 85 percent by volume or less with the objective of preventing the combustibility from deteriorating. The bicyclic aromatic content used herein denotes the value measured in accordance with JPI-5S-49-97 "Petroleum Products-Determination of Hydrocarbon Types-High Performance Liquid Chromatography".

The cracked reformed base oil used in the method for producing a gas oil composition of the present invention has a 10 vol. % distillation temperature (hereinafter abbreviated to "T10") of preferably 160° C. or higher, more preferably 165° C. or higher, more preferably 170° C. or higher and preferably 250° C. or lower, more preferably 245° C. or lower, more preferably 240° C. or lower. If T10 decreases, the light fraction would partially gasify and the unburned hydrocarbon amount in the exhaust gas would increase with the sprayed range is expanded in the engine of a diesel automobile, likely resulting in poor high temperature startability a and rotational stability of the engine when idled. On the other hand, if T10 increases, the low temperature startability and drivability of a diesel automobile tend to be degraded.

The cracked reformed base oil used in the method for producing a gas oil composition of the present invention has a 90 vol. % distillation temperature (hereinafter abbreviated to "T90") of preferably 260° C. or higher, more preferably 270° C. or higher, more preferably 280° C. or higher, and preferably 330° C. or lower, more preferably 325° C. or lower, more preferably 320° C. or lower. If T90 decreases, the fuel consumption rate of a diesel automobile and the high temperature startability and rotational stability of the engine when idled tend to be degraded. When the gas oil composition contains a cold flow improver, the improving effect on the cold filter plugging point obtained thereby tends to be degraded. If T90 increases, the amount of emission of PM from a diesel automobile tends to increase.

The oxidation stability of the cracked reformed base oil used in the method for producing a gas oil composition of the present invention can be expressed by the induction period. If the induction period is short, sludge or deposit is likely to be formed, resulting in adverse effects that the fuel injection nozzles of an engine are susceptible to clogging, causing the power output reduction and the corrosion of metal materials of the fuel tank. The base oil has an induction period of preferably 480 minutes or longer, more preferably 490 minutes or longer, more preferably 500 minutes or longer, particularly preferably 510 minutes or longer with the objective of improving the oxidation stability of the gas oil composition after production thereof.

The induction period used herein denotes the induction period measured in accordance with ASTM D7545-09 "Standard Test Method for Oxidation Stability of Middle Distillate Fuels-Rapid Small Scale Oxidation Test".

The sulfur content of the cracked reformed base oil used in the method for producing a gas oil composition of the present invention is preferably 10 ppm by mass or less with the objective of reducing the amount of harmful exhausted materials from an engine and improving the performances of an exhaust-gas after-treatment system. The sulfur content used herein denotes the values measured in accordance with JIS K2541-6 "Crude oil and petroleum products-Determination of sulfur content (Ultraviolet fluorescence method)".

The cracked reformed base oil used in the present invention is characterized in that it is produced by bringing a feedstock having a 10 vol. % distillation temperature of 140° C. or higher and a 90 vol. % distillation temperature of 380° C. or lower into contact with a catalyst for a cracking and reforming reaction containing a medium pore zeolite and/or a large pore zeolite so that the feedstock undergoes a cracking and reforming reaction at a reaction temperature of 400 to 650° C. and a reaction pressure of 1.5 MPaG or lower for a contact time of 1 to 300 seconds.

More specifically, the cracked reformed base oil is produced by fractional distillation of a cracking and reforming reaction product produced from the following cracking and reforming reaction.

The cracking and reforming reaction is a reaction wherein a feedstock is brought into contact with a catalyst for a cracking and reforming reaction to use saturated hydrocarbons contained in the feedstock as a hydrogen source and subject the saturated hydrocarbons to a hydrogen transfer reaction to partially hydrogenate the polycyclic aromatic hydrocarbons so as to be ring-opened and converted to monocyclic aromatic hydrocarbons or alternatively a reaction wherein saturated hydrocarbons contained in the feedstock or produced through a cracking process is cyclized and dehydrated to monocyclic aromatic hydrocarbons, and can produce a fuel base oil containing mainly aromatic hydrocarbons.

The feedstock for the cracking and reforming reaction is an oil preferably having a 10 vol. % distillation temperature of 140° C. or higher and a 90 vol. % distillation temperature of 380° C. or lower, more preferably a 10 vol. % distillation temperature of 150° C. or higher and a 90 vol. % distillation temperature of 360° C. or lower.

The 10 vol. % distillation temperature and 90 vol. % distillation temperature referred herein denote the values measured in accordance with JIS K2254 "Petroleum products-Determination of distillation characteristics".

Examples of the feedstock having a 10 vol. % distillation temperature of 140° C. or higher and a 90 vol. % distillation temperature of 380° C. or lower include light cycle oils (LCO) produced in a fluid catalytic cracker, hydrorefined oils of LCO, liquefied coal oils, hydrocracked oils from heavy oils, straight-run kerosene, straight-run gas oil, coker kerosenes, coker gas oils, and hydrocracked oils from oil sands.

Examples of the reaction format employed when the feedstock is brought into contact with a catalyst for the cracking and reforming reaction include fixed beds, moving bends, and fluidized beds. Since in the present invention, a heavy fraction is used as the feedstock, a fluidized bed is preferred as it can remove the coke portion deposited on the catalyst in a continuous manner and enables the reaction to proceed in a stable manner. Particularly preferred is a continuous regeneration type fluidized bed, in which the catalyst is circulated between the reactor and a regenerator so that a reaction-regeneration cycle can be continuously repeated. When the feedstock is brought into contact with a catalyst for the cracking and reforming reaction, it is preferably in a gaseous state. The feedstock may be diluted with gas if necessary.

The catalyst for the cracking and reforming reaction contains a crystalline aluminosilicate.

The crystalline aluminosilicate is preferably a medium pore zeolite and/or a large pore zeolite as they can enhance the yield of monocyclic aromatic hydrocarbons.

Medium pore zeolites are those having a 10-membered ring basic structure and may be any of those having AEL, EUO, FER, HEU, MEL, MFI, NES, TON, and WEI type crystal structures. Among these zeolites, MFI-type zeolites are preferred as they can further enhance the yield of monocyclic aromatic hydrocarbons.

Large pore zeolites are those having a 12-membered ring basic structure. Examples of the macroporous zeolite include those having AFI, ATO, BEA, CON, FAU, GME, LTL, MOR, MTW and OFF type crystal structures. Among these zeolites, preferred are those having BEA, FAU and MOR type structures because they can be used for industrial purposes and more preferred are those having a BEA type structure because they can increase the yield of monocyclic aromatic hydrocarbons.

Other than the above medium pore and large pore zeolites, the crystalline aluminosilicate may contain small pore zeolites having a 10-membered ring or smaller basic structure and extra-large pore zeolites having a 14-membered ring or larger basic structure.

Examples of the small pore zeolites include those having ANA, CHA, ERI, GIS, KFI, LTA, NAT, PAU and YUG type crystal structures.

Examples of the extra-large pore zeolites include those having CLO and VPI type crystal structures.

In the case where the cracking and reforming reaction is carried out in a fixed bed, the content of the crystalline aluminosilicate in the catalyst for the cracking and reforming reaction is preferably from 60 to 100 percent by mass, more preferably from 70 to 100 percent by mass, particularly preferably from 90 to 100 percent by mass on the basis of 100 percent by mass of the whole catalyst. If the crystalline aluminosilicate content is 60 percent by mass or more, the yield of monocyclic aromatic hydrocarbons can be sufficiently increased. In the case where the cracking and reforming reaction is carried out in a fluidized bed, the content of the crystalline aluminosilicate in the catalyst for the cracking and reforming reaction is preferably from 20 to 60 percent by mass, more preferably from 30 to 60 percent by mass, particularly preferably from 35 to 60 percent by mass on the basis of 100 percent by mass of the whole catalyst. If the content of the crystalline aluminosilicate is 20 percent by mass or more, the yield of monocyclic aromatic hydrocarbons can be sufficiently increased. If the content of the crystalline aluminosilicate is more than 60 percent by mass, the content of a binder that can be included in the catalyst decreases, and the resulting catalyst would not be suitable for a fluidized bed.

The catalyst for the cracking and reforming reaction preferably contains phosphorus and/or boron. The catalyst for the cracking and reforming reaction if containing phosphorus and/or boron can prevent the yield of monocyclic aromatic hydrocarbons from decreasing over time and also inhibit the formation of coke on the catalyst surface.

Examples of methods for incorporating phosphorus in the catalyst for the cracking and reforming reaction include ion-exchange methods and impregnation methods. More specific examples include methods wherein phosphorus is loaded on a crystalline aluminosilicate, crystalline aluminogallosilicate or crystalline aluminozincosilicate, methods wherein a phosphorus compound is included during synthesis of the zeolite so that a portion of the internal framework of the crystalline aluminosilicate is substituted with phosphorus, and methods wherein a crystallization promoter containing phosphorus is used during synthesis of the zeolite. No particular limitation is imposed on the phosphate ion-containing aqueous solution used in the above-mentioned methods. However, preferably used is a solution prepared by dissolving phosphoric acid, diammonium hydrogen phosphate, ammonium dihydrogen phosphate or another water-soluble phosphoric acid salt at an arbitrary concentration in water.

Examples of methods for incorporating boron in the catalyst for the cracking and reforming reaction include ion-exchange methods and impregnation methods. More specific examples include methods wherein boron is loaded on a crystalline aluminosilicate, crystalline aluminogallosilicate or crystalline aluminozincosilicate, methods wherein a boron compound is included during synthesis of the zeolite so that a portion of the internal framework of the crystalline aluminosilicate is substituted with boron, and methods wherein a crystallization promoter containing boron is used during synthesis of the zeolite.

The content of phosphorus and/or boron in the catalyst for the cracking and reforming reaction is preferably from 0.1 to 10 percent by mass on the basis of the total mass of the catalyst, wherein the lower limit is more preferably 0.5 percent by mass or more and the upper limit is more preferably 9 percent by mass or less, particularly preferably 8 percent by mass. A phosphorus content of 0.1 percent by mass or more on the basis of the total mass of the catalyst can prevent the yield of monocyclic aromatic hydrocarbons from decreasing over time, and a phosphorus content of 10 percent by mass or less can increase the yield of monocyclic aromatic hydrocarbons.

If necessary, the catalyst for the cracking and reforming reaction may contain gallium and/or zinc. Inclusion of gallium and/or zinc results in the increased production rate of monocyclic aromatic hydrocarbons.

Examples of the form of gallium in the catalyst for the cracking and reforming reaction include catalysts wherein gallium is incorporated within the lattice framework of the crystalline aluminosilicate (crystalline aluminogallosilicate), catalysts wherein gallium is supported on the crystalline aluminosilicate (gallium-supporting crystalline aluminosilicate) and catalysts including gallium in the both forms.

Examples of the form of zinc in the catalyst for the cracking and reforming reaction include catalysts wherein zinc is incorporated within the lattice framework of the crystalline aluminosilicate (crystalline aluminogallosilicate), catalysts wherein zinc is supported on the crystalline aluminosilicate (zinc-supporting crystalline aluminosilicate) and catalysts including zinc in the both forms.

A crystalline aluminogallosilicate or a crystalline aluminozincosilicate has a structure in which $SiO_4$, $AlO_4$ and $GaO_4/ZnO_4$ structures exist in the framework. A crystalline aluminogallosilicate or crystalline aluminozincosilicate may be produced for example by gel-crystallization through hydrothermal synthesis, or by insertion of gallium or zinc into the lattice framework of a crystalline aluminosilicate. Alternatively, a crystalline aluminogallosilicate or crystalline aluminozincosilicate may be produced by insertion of aluminum into the lattice framework of a crystalline gallosilicate or crystalline zincosilicate.

A gallium-supporting crystalline aluminosilicate may be produced by loading gallium on a crystalline aluminosilicate with a conventional method such as an ion-exchange method or impregnation method. No particular limitation is imposed on the gallium source used in these methods, and examples of the source include gallium salts, such as gallium nitrate and gallium chloride, and gallium oxide.

A zinc-supporting crystalline aluminosilicate may be produced by loading zinc on a crystalline aluminosilicate with a conventional method such as an ion-exchange method or impregnation method. No particular limitation is imposed on the zinc source used in these methods, and examples of the source include zinc salts such as zinc nitrate and zinc chloride, and zinc oxide.

In the case where the catalyst for the cracking and reforming reaction contains gallium and/or zinc, the content of gallium and/or zinc therein is preferably from 0.01 to 5.0 percent by mass, more preferably from 0.05 to 2.0 percent by mass on the basis of 100 percent by mass of the total mass of the catalyst. A content of gallium and zinc of 0.01 percent by mass or more can further increase the production rate of monocyclic aromatic hydrocarbons, and a content of 5.0 percent by mass or less can further increase the yield of monocyclic aromatic hydrocarbons.

The catalyst for the cracking and reforming reaction is formed into powder, granules or pellets depending on the reaction mode. For example, the catalyst is used in the form of powder for a fluidized bed and in the form of granules or pellets for a fixed bed. The average particle diameter of the catalyst used in a fluidized bed is preferably from 30 to 180 μm, more preferably from 50 to 100 μm. The bulk density of the catalyst used in a fluidized bed is preferably from 0.4 to 1.8 g/cc, more preferably 0.5 to 1.0 g/cc. The average particle diameter denotes the particle diameter at which the particle diameter distribution obtained by classification with a sieve is 50 percent by mass. The bulk density is the value measured in accordance with the method prescribed in JIS R9301-2-3.

In order to produce a granular or pellet catalyst, if necessary, an inert oxide as a binder may be added to the catalyst, followed by molding with any of various molding apparatuses.

In the case where the catalyst for the cracking and reforming reaction contains an inorganic oxide as a binder, a phosphorus-containing binder may be used.

No particular limitation is imposed on the reaction temperature at which the feedstock is brought into contact and then reacted with the catalyst for the cracking and reforming reaction. However, the reaction temperature is preferably from 400 to 650° C. The lower limit reaction temperature needs to be 400° C. or higher so as to allow the easy reaction of the feedstock and is more preferably 450° C. or higher. The upper limit reaction temperature needs to be 650° C. or lower so as to increase sufficiently the yield of monocyclic aromatic hydrocarbons, more preferably 600° C. or lower.

The reaction pressure at which the feedstock is brought into contact and then reacted with the catalyst for the cracking and reforming reaction is preferably 1.5 MPaG or lower, more preferably 1.0 MPaG or lower. The reaction pressure if 1.5 MPaG or lower can restrain the generation of by-product light gas and lower the pressure resistance of the reactor.

No particular limitation is imposed on the contact time of the feedstock and the catalyst for the cracking and reforming reaction if the reaction proceeds as desired. However, for example, the contact time is preferably from 1 to 300 seconds measured when the gas passes across the catalyst for the cracking and reforming reaction. The lower limit contact time is more preferably 5 seconds or longer, and the upper limit contact time is more preferably 150 seconds or shorter. The contact time if 1 second or longer ensures the reaction between the feedstock and the catalyst. The contact time if 300 seconds or shorter can restrain the deposition of carbon on the catalyst due to coking and furthermore suppress the amount of light gas generated by coking.

The cracked and reformed reaction product generated through the above-described cracking and reforming reaction is separated into fractions each having given properties thereby producing the cracked reformed base oil used in the present invention.

In order to separate the cracked and reformed reaction product into given fractions, a conventional distillation unit and gas-liquid separation unit may be used. One example of the distillation unit is a device such as a stripper comprising a multi-stage distillation unit so as to separate a plurality of fractions by distillation. One example of the gas-liquid separation unit is a device containing a gas-liquid separation tank, an inlet pipe for introducing the reaction product into the gas-liquid separation tank, a gas component discharge pipe arranged in the upper section of the gas-liquid separation bath and a liquid component discharge pipe arranged in the lower section of the gas-liquid separation bath.

The cracked and reformed base oil used in the present invention is preferably a fraction containing hydrocarbons of 9 or more carbon atoms.

In the method for producing a gas oil composition of the present invention, a cracked base gas oil is blended in an amount of 10 to 70 percent by volume on the basis of the total mass of the gas oil composition. The cracked base gas oil is a gas oil fraction produced by treating a gas oil fraction having been cracked in a fluid catalytic cracker and/or thermal cracker and/or hydrocarcker alone or in combination with a straight-run gas oil or vacuum gas oil, in a hydrodesulfurization unit.

The content of the cracked base gas oil is 10 percent by volume or more, preferably 20 percent by volume or more, more preferably 30 percent by volume or more with the objective of further improving the low temperature properties and from the viewpoint of effective use of the cracked base gas oil. The content is 70 percent by volume or less, preferably 60 percent by volume or less, more preferably 50 percent by volume or less with the objective of preventing the combustibility from deteriorating.

Examples of other base oils that can be used in the method for producing a gas oil composition of the present invention include petroleum base gas oils and petroleum base kerosenes as well as synthetic base gas oils and synthetic base kerosenes.

Specific examples of petroleum base gas oils include straight-run base gas oils produced by hydrotreating straight-run gas oils obtained from an atmospheric distillation unit for crude oil; vacuum base gas oils produced by hydrotreating vacuum gas oils resulting from vacuum distillation of straight-run heavy oils or residual oils obtained from an atmospheric distillation unit; and hydrodesulfurized base gas oils produced by hydrodesulfurization of straight-run gas oil or vacuum gas oil in one or more stages under more sever conditions than ordinary hydrorefining.

Specific examples of petroleum base kerosenes include straight-run base kerosenes produced by hydrotreating straight-run kerosenes obtained from an atmospheric distillation unit for crude oil; vacuum base kerosenes produced by hydrotreating vacuum kerosenes resulting from vacuum distillation of straight-run heavy oils or residual oils obtained from an atmospheric distillation unit; hydrodesulfurized base kerosenes produced by hydrodesulfurization of straight-run kerosenes or vacuum kerosenes in one or more stages under more sever conditions than ordinary hydrorefining; and cracked base kerosenes produced by hydrodesulfurization of kerosene fractions having been cracked in a fluid catalytic cracker and/or hydrocarcker and/or thermal cracker, alone or in combination with straight-run kerosenes.

Specific examples of synthetic base gas oils and synthetic base kerosenes include GTL base oils synthesized through a Fischer-Tropsch reaction of hydrogen and carbon dioxide.

Necessarily, the gas oil composition of the present invention has an induction period of 60 minutes or longer, a sulfur content of 10 ppm by mass or less and a cetane number of 45 or greater.

The induction period of the gas oil composition of the present invention is 60 minutes or longer, preferably 65 minutes or longer, more preferably 70 minutes or longer, more preferably 75 minutes or longer with the objective of preventing the formation of sludge or deposit. The induction period referred herein denotes the induction period measured in accordance with ASTM D7545-09 "Standard Test Method for Oxidation Stability of Middle Distillate Fuels-Rapid Small Scale Oxidation Test".

The sulfur content of the gas oil composition of the present invention is 10 ppm by mass or less, preferably 9 ppm by mass or less, more preferably 8 ppm or less with the objective of reducing the amount of harmful exhausted materials from an engine and improving the performances of an exhaust-gas after-treatment system. The sulfur content used herein denotes the values measured in accordance with JIS K2541-6 "Crude oil and petroleum products-Determination of sulfur content (Ultraviolet fluorescence method)".

The cetane number of the gas oil composition of the present invention is 45 or greater, preferably 46.5 or greater, more preferably 48 or greater from the viewpoint of the engine ignitability.

No particular limitation is imposed on the cetane index of the gas oil composition of the present invention, which is, however, preferably 45 or greater, more preferably 46.5 or greater, more preferably 48 or greater from the viewpoint of the engine ignitability.

Even in the case where the cetane index is 45 or greater, addition of a cetane number improver can further improve the engine ignitability and also improve the low temperature engine startability and reduce the white smoke generated upon start of an engine. The cetane number and cetane index referred herein are the values measured and calculated according to JIS K 2280, "Petroleum Products-Fuel Oils-Octane Number and Cetane Number Test Methods and Cetane Index Calculation Method".

No particular limitation is imposed on the total aromatic content of the gas oil composition of the present invention, which is, however, preferably 15 percent by volume or more, more preferably 17 percent by volume or more, more preferably 20 percent by volume or more with the objective of retaining the rubber swellablility. On the other hand, the total aromatic content is preferably 50 percent by volume or less, more preferably 45 percent by volume or less, more preferably 40 percent by volume or less with the objective of retaining the exhaust gas performances. The total aromatic content referred herein denotes the value measured in accordance with JPI-5S-49-97 "Petroleum Products-Determination of Hydrocarbon Types-High Performance Liquid Chromatography".

No particular limitation is imposed on the 15° C. density of the gas oil composition of the present invention, which is, however, preferably 0.83 g/cm$^3$ or higher, more preferably 0.835 g/cm$^3$ or higher, more preferably 0.84 g/cm$^3$ or higher with the objective of enhancing the fuel consumption rate. The 15° C. density is preferably 0.86 g/cm$^3$ or lower, more preferably 0.855 g/cm$^3$ or lower with the objective of preventing the combustion failure. The density referred herein denotes the value measured in accordance with JIS K2249 "Crude petroleum and petroleum products-Determination of density and petroleum measurement tables based on a reference temperature (15° C.)".

No particular limitation is imposed on the distillation characteristics of the gas oil composition of the present invention, which, however, desirously satisfy the following characteristics:

10 vol. % distillation temperature: 200 to 290° C.;

50 vol. % distillation temperature: 220 to 300° C.; and 90 vol. % distillation temperature: 270 to 360° C.

The 10 vol. % distillation temperature (hereinafter abbreviated to "T10") is preferably 200° C. or higher, more preferably 210° C. or higher, more preferably 215° C. or higher, particularly preferably 220° C. or higher, and preferably 290° C. or lower, more preferably 270° C. or lower, more preferably 260° C. or lower. If T10 is lower than 200° C., the light fraction would partially gasify and the unburned hydrocarbon amount in the exhaust gas would increase with the sprayed range is expanded in the engine of a diesel automobile, likely resulting in degraded high temperature startability and rotational stability of the engine when idled. On the other hand, if T10 exceeds 290° C., the low temperature startability and drivability of a diesel automobile tends to be degraded.

The 50 vol. % distillation temperature (hereinafter abbreviated to "T50") is preferably 220° C. or higher, more preferably 230° C. or higher, more preferably 240° C. or higher, particularly preferably 250° C. or higher, and preferably 300° C. or lower, more preferably 290° C. or lower, more preferably 285° C. or lower. A T50 of lower than 220° C. tends to decrease the fuel consumption rate of an diesel automobile as well as the engine output, high temperature startability and rotational stability of the engine when idled. On the other hand, a T50 higher than 300° C. tends to increase the amount of particulate matters (hereinafter referred to as "PM") exhausted from the engine of a diesel automobile.

The 90 vol. % distillation temperature (hereinafter abbreviated to "T90") is preferably 270° C. or higher, more preferably 290° C. or higher, more preferably 310° C. or higher, particularly preferably 320° C. or higher, and preferably 360° C. or lower, more preferably 355° C. or lower, more preferably 350° C. or lower. A T90 of lower than 270° C. tends to decrease the fuel consumption rate of an diesel automobile as well as the engine output, high temperature startability and rotational stability of the engine when idled. In the case where the gas oil composition contains a cold flow improver, the improving effect thereof on the cold filter plugging point tends to degrade. On the other hand, a T90 of higher than 360° C. tends to increase the amount of PM exhausted from the engine of an diesel automobile.

The T10, T50 and T90 used herein denote the values measured in accordance with JIS K2254 "Petroleum Products-Distillation Test Methods-Ordinary Pressure Method".

The slow-cooling cloud point of the gas oil composition of the present invention is preferably −5° C. or lower, more preferably −10° C. or lower, more preferably −12° C. or lower, most preferably −14° C. or lower. A slow-cooling cloud point of −5° C. or lower tends to dissolve easily wax that has adhered onto the fuel injector filters of a diesel automobile.

The slow-cooling cloud point referred herein denotes the value measured in the manner described below. Specifically, a sample is placed in a sample container having a bottom surface of aluminum to be 15 mm in height, and light is emitted 3 mm away from the bottom of the container. The sample is then slowly cooled at a rate of 0.5° C./minute from a temperature at least 10° C. or higher than the above-mentioned cloud point, and the temperature at which the reflected light quantity is ⅞ or less of the emitted light (slow-cooling cloud point) is detected in increments of 0.1° C.

If necessary, the gas oil composition of the present invention may contain a cold flow improver. No particular limitation is imposed on the type of cold flow improver, which may be one or more cold flow improvers selected from linear compounds such as ethylene-unsaturated ester copolymers, typically ethylene-vinyl acetate copolymers, alkenylsuccinic amides and polyethylene glycol dibehenic acid ester; polar nitrogen compounds composed of reaction products of acids such as phthalic acid, ethylenediaminetetraacetic acid and nitriloacetic acid or their acid anhydrides with hydrocarbyl-substituted amines; and comb-shaped polymers composed of alkylfumarate or alkylitaconate-unsaturated ester copolymers. Among these cold flow improvers, ethylene-vinyl acetate copolymer additives are preferably used because of their general versatility. In the case where a cold flow improver is added, the amount thereof is preferably from 50 to 500 mg/L, particularly preferably from 50 to 300 mg/L. Commercially available products referred to as cold flow improvers are often in the form in which the active components contributing to low-temperature fluidity are diluted with a suitable solvent. Therefore, the above amount of the cold flow improvers denotes the amount of the active components when such commercially available products are added to the gas oil composition of the present invention.

The gas oil composition of the present invention may contain a lubricity improver with the objective of retaining the lubricity in an injection pump. No particular limitation is imposed on the type of lubricity improver. The gas oil composition may contain one or more ester-, carboxylic acid-, alcohol-, phenol- and amine-based lubricity improvers. Among these lubricity improvers, ester- and carboxylic acid-lubricity improvers are preferably used from the viewpoint of general versatility. An ester-based lubricity improver is preferably used because the effect obtained by addition thereof with respect to the addition concentration unlikely reaches saturation and the HFRR WS1.4 can be lowered. A carboxylic acid-based lubricity improver is preferably used because the initial responsiveness of the effect obtained by addition thereof with respect to the addition concentration is quick and the amount of the lubricity improver can be decreased. The term "HFRR WS1.4 value" used herein is an index for evaluating the lubricity of a gas oil, and means the value measured in accordance with the Japan Petroleum Institute standard JPI-5S-50-98, "Gas Oils-Lubricity Test Method", published by The Japan Petroleum Institute.

Examples of ester-based lubricity improvers include glycerin carboxylic acid esters. One or more carboxylic acids may form a carboxylic acid ester. Specific examples include linoleic acid, oleic acid, salicylic acid, palmitic acid, myristic acid and hexadecenoic acid. Examples of carboxylic acid-based lubricity improvers include linoleic acid, oleic acid, salicylic acid, palmitic acid, myristic acid and hexadecenoic acid, any one or more of which may be used. In the case where a cold flow improver has a lubricity improving effect, too, the combination of the cold flow improver and lubricity improver can improve the lubricity.

In the case where a lubricity improver is added, the amount thereof is preferably from 25 to 500 mg/L, more preferably from 25 to 300 mg/L, more preferably from 25 to 200 mg/L. Within these ranges, the lubricity is preferably added so that the HFRR WS1.4 is preferably 500 μm or less, more preferably 460 μm or less, more preferably 420 μm or less, most preferably 400 μm or less. Commercially available products referred to as lubricity improvers are often in the form in which the active components contributing to lubricity are diluted with a suitable solvent. Therefore, the above amount of the lubricity improvers denotes the amount of the active components when such commercially available products are added to the gas oil composition of the present invention.

The gas oil composition of the present invention may contain an anti-oxidant. No particular limitation is imposed on the type of anti-oxidant. However, phenol- or amine-based anti-oxidants are preferably used. Examples of phenol-based anti-oxidants include 4,4'-methylenebis(2,6-di-tert-butylphenol),
4,4'-bis(2,6-di-tert-butylphenol),
4,4'-bis(2-methyl-6-tert-butylphenol),
2,2'-methylenebis(4-ethyl-6-tert-butylphenol),
2,2'-methylenebis(4-methyl-6-tert-butylphenol),
4,4'-butylidenebis(3-methyl-6-tert-butylphenol),
4,4'-isopropylidenebis(2,6-di-tert-butylphenol),
2,2'-methylenebis(4-methyl-6-nonylphenol),
2,2'-isobutylidenebis(4,6-dimethylphenol),
2,2'-methylenebis(4-methyl-6-cyclohexylphenol),
2,6-di-tert-butyl-4-methylphenol,
2,6-di-tert-butyl-4-ethylphenol,
2,4-dimethyl-6-tert-butylphenol,
2,6-di-tert-α-dimethylamino-p-cresol,
2,6-di-tert-butyl-4(N,N'-dimethylaminomethylphenol),
4,4'-thiobis(2-methyl-6-tert-butylphenol),
4,4'-thiobis(3-methyl-6-tert-butylphenol),
2,2'-thiobis(4-methyl-6-tert-butylphenol),
bis(3-methyl-4-hydroxy-5-tert-butylbenzyl)sulfide,
bis(3,5-di-tert-butyl-4-hydroxybenzyl)sulfide,
2,2'-thio-diethylenebis[3-(3,5-di-tert-butyl-4-hydroxyphenyl)propionate],
tridecyl-3-(3,5-di-tert-butyl-4-hydroxyphenyl)propionate,
pentaerythrityl-tetraquis[3-(3,5-di-tert-butyl-4-hydroxyphenyl)propionate], and octadecyl-3-(3,5-di-tert-butyl-4-hydroxyphenyl)propionate. Examples of the amine-based anti-oxidants include phenyl-α-naphtylamines, alkylphenyl-α-naphtylamines, and dialkyldiphenylamine. Commercially available products referred to as anti-oxidants are often in the form in which the active components contributing to an improvement in oxidation stability are diluted with a suitable solvent. Therefore, when such products are added to the gas oil composition of the present invention, they are necessarily added in an amount on the basis of the active components.

The gas oil composition of the present invention may further contain any additives other than the cold flow improver, lubricity improver and anti-oxidant. Examples of such additives include cetane number improvers such as nitric acid ester-based cetane number improvers typically 2-ethylhexylnitrate and organic peroxide-based cetane number improvers, detergents such as alkenylsuccinic acid derivative and carboxylic acid amine salts, metal deactivators such as salicylidene derivatives, deicing agents such as polyglycol ethers, corrosion inhibitors such as aliphatic amines and alkenylsuccinic acid esters, antistatic agents such as anionic, cationic and amphoteric surfactants, coloring agents such as azo dyes, and silicon-based antifoaming agent. These additives may be added alone or in combination of two or more types. The amounts of additives are arbitrarily selected, but the total amount of the additives is usually preferably 0.5 percent by mass or less, preferably 0.2 percent by mass or less as the amount of the effective components on the basis of the total mass of the gas oil composition.

EXAMPLES

The gas oil composition of the present invention will be described with reference to the following examples. The present invention can be accomplished if implemented in the manner of the following examples but are not limited thereto.

The methods for measuring and evaluating physical properties are carried out in the following manners.

1) density: method prescribed in JIS K2249 "Crude petroleum and petroleum products-Determination of density and petroleum measurement tables based on a reference temperature (15° C.)"

2) cetane number: method prescribed in JIS K 2280, "Petroleum Products-Fuel Oils-Octane Number and Cetane Number Test Methods and Cetane Index Calculation Method"

3) sulfur content: method prescribed in JIS K2541-6 "Crude oil and petroleum products-Determination of sulfur content (Ultraviolet fluorescence method)"

4) distillation characteristics: method prescribed in JIS K2254 "Petroleum Products-Distillation Test Methods-Ordinary Pressure Method"

5) slow-cooling cloud point: method wherein a sample is placed in a sample container having a bottom surface of aluminum to be 15 mm in height, and light is emitted 3 mm away from the bottom of the container, and the sample is then slowly cooled at a rate of 0.5° C./minute from a temperature at least 10° C. or higher than the above-mentioned cloud point, and the temperature at which the reflected light quantity is ⅞ or less of the irradiated light (slow-cooling cloud point) is detected in increments of 0.1° C.

6) total aromatic content, bicyclic aromatic content: method prescribed in JPI-5S-49-97 "Petroleum Products-Determination of Hydrocarbon Types-High Performance Liquid Chromatography"

7) induction period: method prescribed in ASTM D7545-09 "Standard Test Method for Oxidation Stability of Middle Distillate Fuels-Rapid Small Scale Oxidation Test"

8) amount of sludge formation: method prescribed in ASTM D22 74-10 "Standard Test Method for Oxidation Stability of Distillate Fuel Oil (Accelerated Method)" and indicated by a relative value with respect to 100 of Comparative Example 1.

Examples 1 to 7 and Comparative Examples 1 and 2

Gas oil compositions were prepared using base oil A produced by hydrotreating a straight-run gas oil, base oil B that is a cracked base gas oil produced by treating a gas oil fraction having been cracked in a fluid catalytic cracker, in a hydrodesulfurization unit, base oil C produced by treating a gas oil fraction having been cracked in a thermal cracker and then mixed with vacuum gas oil, in a hydrodesulfurization unit, and base oil D that is a cracked reformed base oil. Properties of base oils A to D are set forth in Table 1 below. Formulations and properties of gas oil compositions thus prepared (Examples 1 to 7 and Comparative Examples 1 and 2) are set forth in Table 2.

Base oil D was produced in the following manner.

(Production of Base Oil D)

A light cycle oil LCO (10 vol. % distillation temperature of 215° C., 90 vol. % distillation temperature of 318° C., 15° C. density of 0.9258 g/cm$^3$, saturate content of 23 percent by volume, olefin content of 2 percent by volume, total aromatic content of 75 percent by volume) was brought into contact with a catalyst for a cracking and reforming reaction (MFI type zeolite supporting 0.2 percent by mass of gallium and 0.7 percent by mass of phosphorus and containing a binder) to be reacted under conditions of a reaction temperature of 538° C., a reaction pressure of 0.3 MPaG, a contact time of the LCO and the catalyst of 60 seconds in a fluidized bed reactor so as to be cracked and reformed. The cracked and reformed reaction product was fractioned by distillation thereby producing a cracked and reformed base oil (base oil D) having the properties set forth in Table 1.

TABLE 1

| Items | | Base oil A | Base oil B | Base oil C | Base oil D |
|---|---|---|---|---|---|
| Density (@15° C.) | g/cm$^3$ | 0.8258 | 0.8871 | 0.8699 | 1.0229 |
| Cetane number | | 62.1 | 29.3 | 41.5 | 6.4 |
| Sulfur Content | mass % | 8 | 4 | 8 | 10 |
| 10 vol. % distillation temperature | ° C. | 229.5 | 217.0 | 271.0 | 192.5 |
| 50 vol. % distillation temperature | ° C. | 285.0 | 246.0 | 282.5 | 237.0 |
| 90 vol. % distillation temperature | ° C. | 340.5 | 299.5 | 299.0 | 290.5 |
| Slow-cooling cloud point | ° C. | −4 | −25 | −23 | −25 or lower |
| Total aromatic content | vol % | 16.9 | 53.2 | 39.3 | 99.4 |
| Bicyclic aromatic content | vol % | 1.2 | 2.5 | 5.2 | 79.3 |
| Induction period | min | 77 | 16 | 37 | 567 |

TABLE 2

| Base oil blend ratio | | Example 1 | Example 2 | Example 3 | Example 4 | Example 5 | Example 6 | Example 7 | Comparative Example 1 | Comparative Example 2 |
|---|---|---|---|---|---|---|---|---|---|---|
| Base oil A | vol % | 59.5 | 59.0 | 28.5 | 48.5 | 55.0 | 60.0 | 89.5 | 60.0 | 30.0 |
| Base oil B | vol % | 40.0 | 40.0 | | | | | 10.0 | 40.0 | |
| Base oil C | vol % | | | 70.0 | 50.0 | 40.0 | 30.0 | | | 70.0 |
| Base oil D | vol % | 0.5 | 1.0 | 1.5 | 1.5 | 5.0 | 10.0 | 0.5 | | |
| Total | vol % | 100.0 | 100.0 | 100.0 | 100.0 | 100.0 | 100.0 | 100.0 | 100.0 | 100.0 |
| Density (@15° C.) | g/cm$^3$ | 0.8513 | 0.8523 | 0.8596 | 0.8508 | 0.8533 | 0.8587 | 0.8329 | 0.8503 | 0.8567 |
| Cetane number | | 48.4 | 48.1 | 46.5 | 50.6 | 50.7 | 50.0 | 58.0 | 48.9 | 47.7 |
| Sulfur Content | mass % | 6 | 6 | 8 | 8 | 8 | 8 | 8 | 6 | 8 |

TABLE 2-continued

| Base oil blend ratio | | Example 1 | Example 2 | Example 3 | Example 4 | Example 5 | Example 6 | Example 7 | Comparative Example 1 | Comparative Example 2 |
|---|---|---|---|---|---|---|---|---|---|---|
| 10 vol. % distillation temperature | ° C. | 220.5 | 220.0 | 262.0 | 253.5 | 237.0 | 229.5 | 229.5 | 220.5 | 263.0 |
| 50 vol. % distillation temperature | ° C. | 268.0 | 267.0 | 283.0 | 283.0 | 282.0 | 280.5 | 284.0 | 268.5 | 283.0 |
| 90 vol. % distillation temperature | ° C. | 332.5 | 332.5 | 307.5 | 325.0 | 330.5 | 333.5 | 343.5 | 333.0 | 308.0 |
| Slow-cooling cloud point | ° C. | −12 | −12 | −18 | −14 | −13 | −14 | −5 | −11 | −17 |
| Total aromatic content | vol % | 31.8 | 32.2 | 33.8 | 29.3 | 30.0 | 31.9 | 20.9 | 31.4 | 32.6 |
| Bicyclic aromatic content | vol % | 2.1 | 2.5 | 5.2 | 4.4 | 6.7 | 10.2 | 1.7 | 1.7 | 4.0 |
| Induction period | min | 65 | 73 | 76 | 83 | 131 | 185 | 82 | 53 | 49 |
| Amount of sludge formation | | 28.1 | 13.8 | 11.3 | 6.3 | 0.0 | 0.0 | 8.1 | 100 | 125.1 |

From Table 2, it is understood that the induction period of Comparative Examples 1 and 2 containing no cracked reformed base oil is short. In comparison with these comparative examples, it is understood that Examples 1 to 7 containing 0.5 percent by volume or more of a cracked reformed base oil are long in induction period and less in the amount of sludge formation and thus has an excellent oxidation stability improving effect owing to the use of the cracked reformed base oil.

INDUSTRIAL APPLICABILITY

The present invention is significantly useful for the industry because it can produce a gas oil composition that is improved in oxidation stability and thus forms less deposit or sludge by inclusion of 0.5 to 15 percent by volume of a cracked reformed base oil with the effective use of a cracked base gas oil that is poor in oxidation stability.

The invention claimed is:

1. A method for producing a gas oil composition with an induction period of 60 minutes or longer, a sulfur content of 10 ppm by mass or less and a cetane number of 45 or greater, comprising blending 0.5 to 15 percent by volume of a cracked reformed base oil having the following properties (1) to (4) and 10 to 70 percent by volume of a cracked base gas oil:

(1) a total aromatic content of 80 to 100 percent by volume;

(2) a bicyclic aromatic content of 40 to 95 percent by volume;

(3) a 10 vol. % distillation temperature of 160 to 250° C.; and (4) a 90 vol. % distillation temperature of 260 to 330° C.

2. The method for producing a gas oil composition according to claim 1, wherein the composition has a slow-cooling cloud point of −5° C. or lower.

3. The method for producing a gas oil composition according to claim 2, wherein the cracked reformed base oil is produced by bringing a feedstock having a 10 vol. % distillation temperature of 140° C. or higher and a 90 vol. % distillation temperature of 380° C. or lower into contact with a catalyst for a cracking and reforming reaction containing a medium pore zeolite and/or a large pore zeolite to be cracked and reformed through a cracking and reforming reaction at a reaction temperature of 400 to 650° C. and a reaction pressure of 1.5 MPaG or lower for a contact time of 1 to 300 seconds.

4. A gas oil composition produced by the method according to claim 2.

5. The method for producing a gas oil composition according to claim 1, wherein the cracked reformed base oil is produced by bringing a feedstock having a 10 vol. % distillation temperature of 140° C. or higher and a 90 vol. % distillation temperature of 380° C. or lower into contact with a catalyst for a cracking and reforming reaction containing a medium pore zeolite and/or a large pore zeolite to be cracked and reformed through a cracking and reforming reaction at a reaction temperature of 400 to 650° C. and a reaction pressure of 1.5 MPaG or lower for a contact time of 1 to 300 seconds.

6. A gas oil composition produced by the method according to claim 5.

7. A gas oil composition produced by the method according to claim 1.

* * * * *